United States Patent [19]

Jasinski et al.

[11] 4,384,931

[45] May 24, 1983

[54] METHOD FOR THE ELECTROLYTIC PRODUCTION OF HYDROGEN PEROXIDE

[75] Inventors: Raymond J. Jasinski, Mission Viejo; Christa G. Kuehn, Irvine, both of Calif.

[73] Assignee: Occidental Research Corporation, Irvine, Calif.

[21] Appl. No.: 299,288

[22] Filed: Sep. 4, 1981

[51] Int. Cl.[3] ..... C25B 1/30

[52] U.S. Cl. ..... 204/84

[58] Field of Search ..... 204/84, 258, 265, 129

[56] References Cited

U.S. PATENT DOCUMENTS

| | | | |
|---|---|---|---|
| 3,124,520 | 3/1964 | Juda | 204/265 |
| 3,591,470 | 7/1971 | Grangaard | 204/84 |
| 3,856,640 | 12/1974 | Halfar et al. | 204/265 |
| 3,969,201 | 7/1976 | Oloman et al. | 204/84 |
| 4,118,305 | 10/1978 | Oloman et al. | 204/265 |
| 4,142,949 | 3/1979 | Faul et al. | 204/84 |
| 4,260,469 | 4/1981 | McIntyre et al. | 204/265 |
| 4,299,682 | 11/1981 | Oda et al. | 204/265 |
| 4,305,793 | 12/1981 | Broniewski | 204/266 |
| 4,312,720 | 1/1982 | Lefevre | 204/265 |

*Primary Examiner*—R. L. Andrews

*Attorney, Agent, or Firm*—Walter A. Hackler

[57] ABSTRACT

A method and apparatus for producing hydrogen peroxide in caustic solution utilizing an electrolytic cell having two electrolytes, one acidic, one basic, separated by a membrane permeable to positive ions. Electrolysis of oxygen which diffuses through a gas-diffusion cathode forms peroxide in caustic catholyte while hydrogen ions generated at an anode are allowed to migrate into the catholyte by the membrane. Peroxide produced in the catholyte upon circulation of catholyte in the cell a product can be produced having a caustic to peroxide ratio of less than 1.0 at five percent peroxide, by weight.

9 Claims, 4 Drawing Figures

METHOD FOR THE ELECTROLYTIC PRODUCTION OF HYDROGEN PEROXIDE

Figure 1:
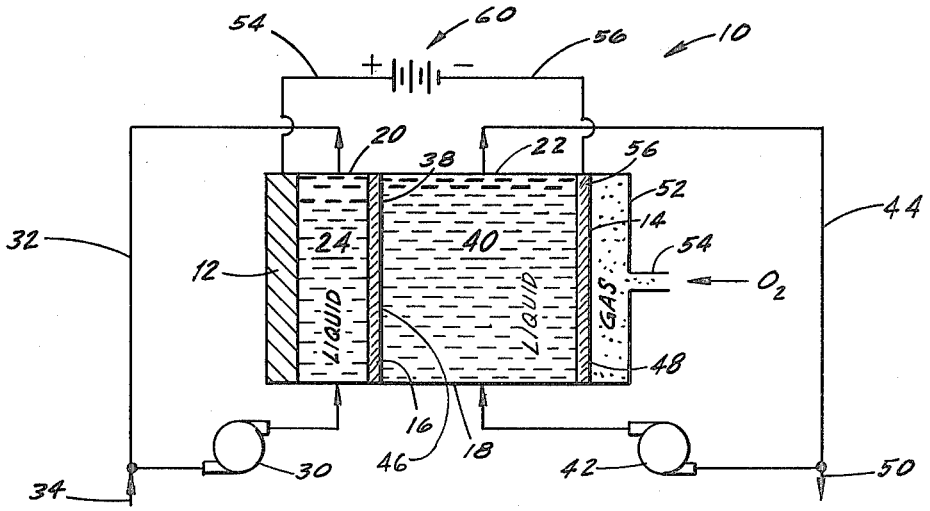

The present invention is generally related to the production of hydrogen peroxide and more particularly to the electrolytic production of hydrogen peroxide in alkaline solutions.

The production of hydrogen peroxide by the electroreduction of oxygen has been known for some time however, such a process has yet to be utilized commercially for producing hydrogen peroxide solutions. Dilute caustic peroxide solutions are particularly suitable and used in the wood pulp bleaching industry. In addition to the bleaching of wood pulp, alkaline solutions of hydrogen peroxide are suitable for other bleaching applications and chemical bleaching operations.

Electrochemically produced hydrogen peroxide in low concentrations may be used without further concentration in such bleaching operations, hence, on-site electrochemical hydrogen peroxide production has been contemplated for supplying hydrogen peroxide at wood pulp plants for bleaching.

A major disadvantage present methods of electrolytic preparation of alkaline peroxide solutions is that the inherent caustic to peroxide ratio (by mole) is considerably larger than the 1 to 1 ratio generally considered a maximum in the industry.

In fact, in a typical electrochemical cell for the production of hydrogen peroxide in an alkaline electrolyte such as sodium hydroxide, the cathode reaction yields:

$$H_2O+O_2+2Na^++2e \longrightarrow NaOH+NaHO_2 \quad (1)$$

Hence, it is evident that the minimum ratio of sodium ion to peroxide is 2. In operation, typical electrochemical cells produce product sodium peroxide solutions with sodium to peroxide ratios for greater than 2.

The present invention includes a method suitable for producing hydrogen peroxide in an on-site location which can produce hydrogen peroxide in an alkaline solution having caustic to peroxide ratios suitable for direct use in the pulp bleaching industry.

SUMMARY OF THE INVENTION

In accordance with the present invention a method for producing hydrogen peroxide comprises the steps of introducing an acidic aqueous anolyte between an acid resistant anode and a first surface on a membrane permeable only to positive ions; introducing a basic aqueous catholyte between a second surface on the membrane and a first surface on a gas-diffusion cathode; introducing oxygen-containing gas to a second surface on a said gas-diffusion cathode; and, connecting said acid resistant anode and said gas-diffusion cathode with an external power supply for causing, (i) the oxygen to be reduced at said diffusion cathode to produce $O_2H^-$ ions within said basic aqueous catholyte, (ii) the water in said acidic aqueous anolyte to be oxidized to produce hydrogen ions ($H^+$), oxygen and electrons within said acidic aqueous anolyte, and (iii) the hydrogen ions ($H^+$), to move through the membrane from the acid aqueous anolyte to the basic aqueous catholyte whereupon said hydrogen ions ($H^+$) react with the $HO_2^-$ ions to produce hydrogen peroxide within said basic aqueous catholyte.

More particularly the method is useful for producing a solution comprising sodium hydroxide and hydrogen peroxide wherein the anode comprises lead oxide or ruthenium oxide, the cathode comprises graphitized carbon black, the acidic aqueous anolyte comprises a sulfuric acid solution and the basic aqueous catholyte comprises a sodium hydroxide solution.

Apparatus in accordance with the present invention for producing hydrogen peroxide includes an acid resistant anode; a gas-diffusion cathode; a membrane permeable only to positive ions disposed between said acid resistant anode and said gas-diffusion cathode; means for passing an acidic aqueous anolyte between the acid resistant anode and a first surface on the membrane; means for passing a basic aqueous catholyte between a second surface on the membrane and a first surface on the gas-diffusion cathode; means for introducing an oxygen-containing gas to a second surface on a said gas-diffusion cathode; and, means for connecting said acid resistant anode and said gas-diffusion cathode with an external power supply for causing, (i) the oxygen to be reduced at said diffusion cathode to produce $O_2H^-$ ions within said basic aqueous catholyte, (ii) the water in said acidic aqueous anolyte to be oxidized to produce hydrogen ions ($H^+$), oxygen and electrons within said acidic aqueous anolyte, and (iii) the hydrogen ions ($H^+$) to move through the membrane from the acid aqueous anolyte to the basic aqueous catholyte whereupon said hydrogen ion ($H^+$) react with the $HO_2^-$ ions to produce hydrogen peroxide within said basic aqueous catholyte.

DRAWING

Figure 2:
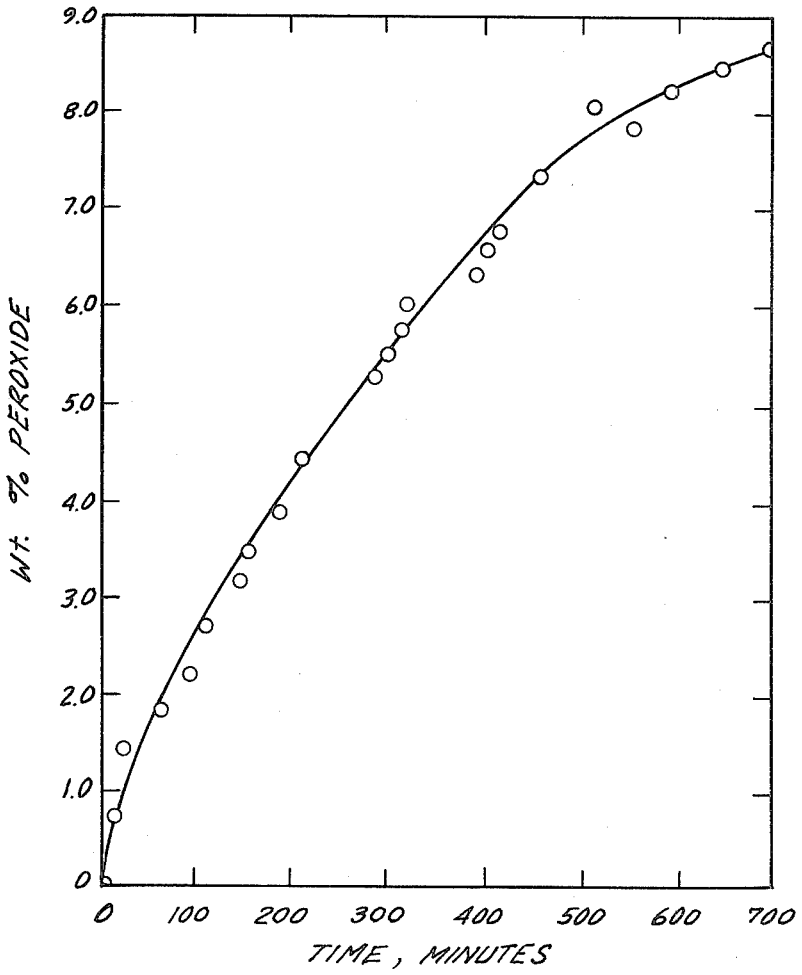
Figure 3:
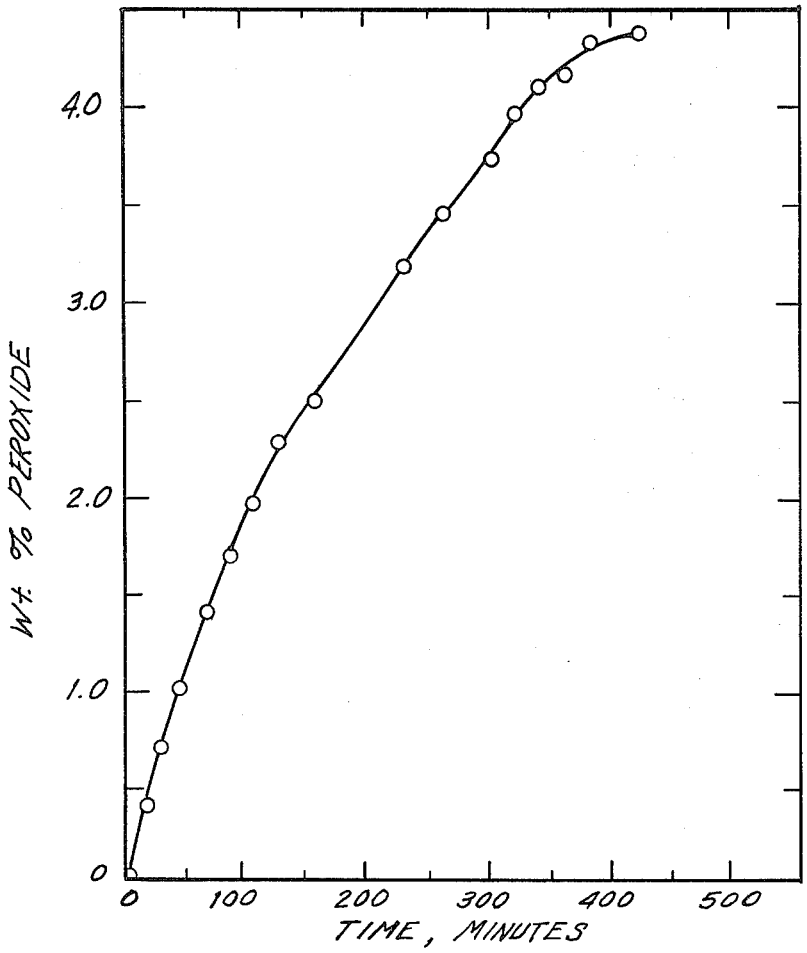
Figure 4:
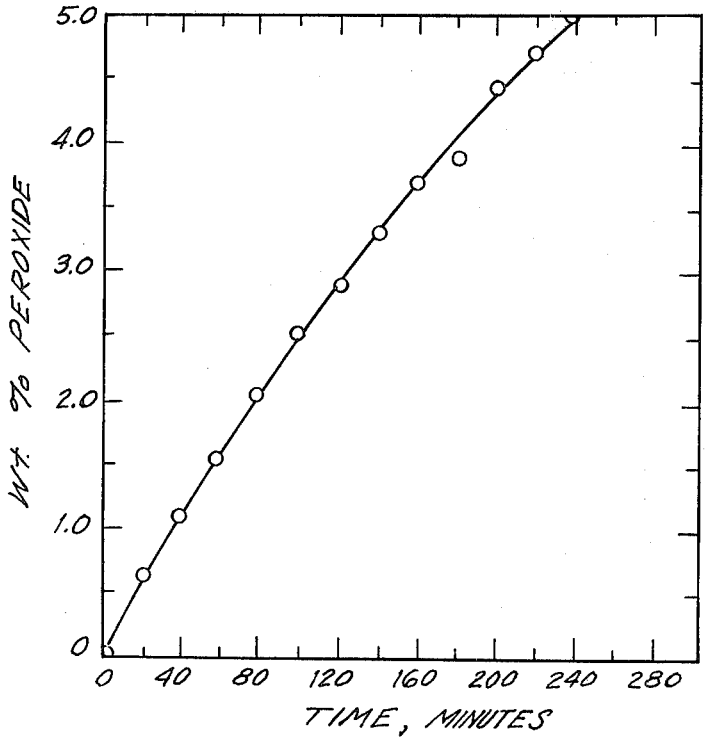

Other advantages of the present invention will appear more clearly from the following drawings in which:

FIG. 1 is a diagramatic drawing showing apparatus and a method for producing hydrogen peroxide utilizing an electrolytic cell having an anode and a cathode compartment with an acidic aqueous anolyte and a basic aqueous catholyte therein separated by a semipermeable membrane; and FIGS. 2, 3 and 4 are plots of weight percent peroxide in basic aqueous catholyte produced in accordance with the apparatus and method of the present invention as a function of time of the experiment.

DESCRIPTION

Turning now to FIG. 1 there is generally shown apparatus 10 for producing hydrogen peroxide in a sodium hydroxide solution which generally includes an anode 12, cathode 14, and a membrane 16 disposed therebetween, all within an outside shell, or casing, 18 to form an anode compartment 20 and a cathode compartment 22.

It is to be appreciated that although a rectangular configuration of the apparatus is illustrated in FIG. 1, the actual shape of the anode cathode membrane and overall cell may be of any suitable shape which provides a relationship between the anode 12 cathode 14 and membrane 16 as depicted in the schematic FIG. 1. Further, the figure also serves as a flow diagram for the method of the present invention.

The anode 12 may be any dimensionally stable anode (DSA) which is stable, or resistant, to sulfuric acid. Examples of anode material include lead, lead oxide coated on graphite, ruthenium oxide, or ruthenium oxide coated on titanium and commercially available from Diamond Shamrock Corp. The acidic aqueous anolyte 24, such as, sulfuric acid, may be circulated through the anode compartment 20 by a pump 30 via lines 32 and water may be added as needed, to the anolyte 24 to replenish hydrogen ions which migrate through the membrane 16 into the catholyte in the cathode compartment 26 by means of a line 34.

As the acidic aqueous anolyte is circulated, or passed, through the anode compartment 20 it contacts the acid resistant anode 12 and a first surface 38 of the membrane 16 which is permeable only to positive ions, such as Nafion 415 which is commercially available from E. I. duPont deNemours & Company. As will be hereinafter discussed in greater detail, the membrane 16 enables passage of hydrogen ions ($H^+$) from the anolyte 24 into a basic aqueous catholyte 40 contained in the cathode compartment 22, but prevents the passage of anions in the catholyte from entering the anode compartment 20 and anolyte 24.

A second pump 42 and line 44 provide a means for passing the basic aqueous catholyte 40 such as a dilute sodium hydroxide solution, through the cathode compartment 22 and in contact with a second surface 46 on the membrane 16 and a first surface 48 on the gas-diffusion cathode 14. As hereinafter discussed in greater detail, hydrogen peroxide is formed within the catholyte and when the concentration thereof reaches a preselected level, product may be withdrawn from the catholyte compartment 26 via an output line 50.

The cathode 14 is a gas-diffusion type, well known in the art, having a porous structure enabling passage of oxygen gas therethrough. A chamber 52 having an inlet 54 therein provides a means for introducing an oxygen containing gas, such as air, to a second surface 56 on the gas-diffusion cathode 14.

Electrical lines 54, 56 provide a means for connecting the acid resistant anode 12 and the gas-diffusion cathode 14 respectively, with an external power supply 60 for causing oxygen which is introduced to the second surface of the gas-diffusion cathode to be reduced at the gas-diffusion cathode first surface 48 after diffusion into the cathode to produce $OH^-$ and $O_2H^-$ ions within the basic aqueous catholyte.

In addition, interconnection of the anode 12 and the cathode 14 with the power supply 60 causes water in the acidic aqueous anolyte to be oxidized to produce hydrogen ions, oxygen and electrons within the acidic aqueous anolyte in the anode compartment 20. Further, the electric field established between the anode and the cathode 14 by the external power supply 60 causes the hydrogen ions to move through the Nafion membrane 46 from the acid aqueous anolyte 24 to the basic aqueous catholyte 40 whereupon the hydrogen ions react with the $OH^-$ and $HO_2^-$ ions to produce hydrogen peroxide and water within the basic aqueous catholyte.

In operation, water in the anolyte 24 is electrolyzed to form oxygen, hydrogen ions and electrons, $$2H_2O \rightarrow O_2 + 4H^+ + 4e^- \quad (2)$$

As electron flow is from the anode to the cathode, electrical neutrality requires that the hydrogen ions ($H^+$) leave the anolyte or that anions enter from the catholyte 40 into the anolyte 24. Since the membrane 16 is permeable to positive ions only, the hydrogen ions ($H^+$) migrate toward the cathode 14 through the membrane 16 and into the catholyte 40.

At the cathode, oxygen diffuses through the cathode 14 and reacts with the hydrogen ions ($H^+$) migrating through the membrane 14 from the anolyte 24 and sodium ions present in the catholyte 40 to form sodium hydroxide and hydrogen peroxide, $$2H_2O + 2O_2 + 2H^+ + 2Na^+ + 4e^- \rightarrow 2NaOH + 2\text{-}H_2O_2 \quad (3)$$

at high current densities the cathode reaction may be, $$3/2O_2 + 3H^+ + Na^+ + 4e^- \rightarrow NaOH + H_2O_2 \quad (4)$$

It is evident that the ratio of caustic to peroxide produced by the reactions (3) and (4) is 1.0, however, the hydrogen ions ($H^+$) migrating into the catholyte cause the reaction.

$$NaOH + H^+ \rightarrow H_2O + Na^+ \quad (5)$$

This lowers the caustic to peroxide ratio below 1.0 since the sodium ion again reacts in accordance with equation (3) and (4) to produce more peroxide.

Further, acid is not consumed in the present method because the hydrogen ions ($H^+$) are produced by electrolsis of water at the anode.

The following examples are presented by way of illustration only, and are not to be considered limiting to the present invention.

EXAMPLE I

An electrolytic cell was constructed in accordance to the schematic diagram shown in FIG. 1, in which the anode cathode and membrane were of a circular configuration and held in a spaced apart relationship by a lucite or acrylic framework. The cathode comprised Vulcan XC-72 carbon black and telfon in a porous configuration as is well known in the art, and had a radius of approximately 2.5 inches. The DSA comprised lead, had a radius of approximately 2.5 inches and the membrane, comprised Nafion 415 was approximately 0.012 inches thick.

The cell was assembled with the membrane spaced apart from the anode approximately 1/16 of an inch and spaced apart from the cathode approximately 5/16 of an inch to form the anode and cathode compartments therebetween respectively. Approximately two hundred milliliters of 0.5 M sodium hydroxide solution was circulated through the cathode compartment, and approximately 100 milliliters of 1.0 M sulfuric acid was circulated through the anode compartment at a rate of about 120 milliliters per minute. The current through the cell was regulated at approximately 5 amperes at a cell voltage of between approximately 3 and 5 volts which yielded anode current density of approximately 394 amps/$m^2$ and a cathode current density of approximately 394 amps/$m^2$. Oxygen gas was introduced to the gas-diffusion cathode at approximately 0.14–0.17 psig.

FIG. 2 shows the weight percent peroxide and the cathode solution as a function of the time of the catholyte in the cathode compartment in minutes. The caustic (sodium ion) to peroxide ratio equalled approximately 1 to 5 at approximately 8½% peroxide after about 700 minutes. The weight percent peroxide includes total peroxide, that is $HO_2^-$ and $H_2O_2$.

EXAMPLE II

FIG. 3 shows the results for the same cell configuration as described in Example 1, except the cathode was composed of graphitized Vulcan XC-72 carbon black and teflon. In this second example the caustic (sodium ion) to peroxide ratio was approximately 1 to 2.6 at approximately 4.3% peroxide after about 600 minutes.

EXAMPLE III

FIG. 4 shows the results for the same cell configuration as described in Example 1, except the anode was composed of lead oxide. In this third example the caustic (sodium ion) to peroxide ratio was approximately 1 to 4.5 at approximately 5% peroxide after about 250 minutes.

Although there has been described hereinabove a specific method and arrangement of apparatus for the production of hydrogen peroxide in accordance with the invention for purposes of illustrating the manner in which the invention may be used to advantage, it will be appreciated that the invention is not limited thereto.

Accordingly, any and all modifications, variations or equivalent methods and arrangements which may occur to those skilled in the art should be considered to be within the scope of the invention as defined in the appended claims.

What is claimed is:

1. A method for producing hydrogen peroxide comprising the steps of:
   (a) introducing an acidic aqueous anolyte between an acid resistant anode and a first surface of a membrane permeable only to positive ions;
   (b) introducing a basic aqueous catholyte between a second surface on the membrane and a first surface on a gas-diffusion cathode;
   (c) introducing oxygen-containing gas to a second surface on said gas-diffusion cathode;
   (d) connecting said acid resistant anode and said gas-diffusion cathode with an external power supply for causing,
      (i) the oxygen to be reduced at said diffusion cathode to produce $O_2H^-$ ions within said basic aqueous catholyte,
      (ii) the water in said acidic aqueous anolyte to be oxidized to produce hydrogen ions ($H^-$) within said acidic aqueous anolyte, and
      (iii) the hydrogen ions ($H^+$) to move through the membrane from the acid aqueous anolyte to the basic aqueous catholyte whereupon said hydrogen ions ($H^+$) react with the $HO_2^-$ ions to produce hydrogen peroxide within said basic aqueous catholyte; and,
   (e) withdrawing basic aqueous catholyte and hydrogen peroxide from between the membrane second surface and the gas-diffusion cathode first surface.

2. A method for producing hydrogen peroxide comprising the steps of:
   (a) passing an acidic aqueous anolyte between an acid resistant anode and a first surface on a membrane permeable only to positive ions;
   (b) passing a basic aqueous catholyte between a second surface on the membrane and a first surface on a gas-diffusion cathode;
   (c) introducing oxygen-containing gas to a second surface on a said gas-diffusion cathode; and
   (d) connecting said acid resistant anode and said gas-diffusion cathode with an external power supply for causing,
      (i) the oxygen to be reduced at said diffusion cathode to produce $OH^-$ and $O_2H^-$ ions within said basic aqueous catholyte,
      (ii) the water in said acidic aqueous anolyte to be oxidized to produce hydrogen ions ($H^+$), within said acidic aqueous anolyte, and
      (iii) the hydrogen ions ($H^+$) to move through the membrane from the acid aqueous anolyte to the basic aqueous catholyte whereupon said hydrogen ions ($H^+$) react with the $OH^-$ and $OH_2^-$ ions to produce water and hydrogen peroxide within said basic aqueous catholyte.

3. A method for producing hydrogen peroxide comprising the steps of:
   (a) introducing an acidic aqueous anolyte between an acid resistant anode and a first surface of a membrane permeable only to positive ions;
   (b) introducing a basic aqueous catholyte between a second surface on the membrane and a first surface on a gas-diffusion cathode, said membrane separating said acidic aqueous anolyte and said basic aqueous catholyte;
   (c) introducing oxygen-containing gas to a second surface on a said gas-diffusion cathode;
   (d) connecting said acid resistant anode and said gas-diffusion cathode with an external power supply for causing,
      (i) the oxygen to be reduced at said diffusion cathode to produce $O_2H^-$ ions within said basic aqueous catholyte,
      (ii) the water in said acidic aqueous anolyte to be oxidized to produce hydrogen ions ($H^+$), within said acidic aqueous anolyte, and
      (iii) the hydrogen ions ($H^+$) to move through the membrane from the acid aqueous anolyte to the basic aqueous catholyte whereupon said hydrogen ions ($H^+$) react with the $HO_2^-$ ions to produce hydrogen peroxide within the basic aqueous catholyte; and,
   (e) withdrawing basic aqueous catholyte and hydrogen peroxide from between the membrane second surface and the gas-diffusion cathode first surface.

4. A method for producing hydrogen peroxide comprising the steps of:
   (a) passing a sulfuric acid solution anolyte between an acid resistant anode and a first surface on a membrane permeable only to positive ions;
   (b) passing a sodium hydroxide solution catholyte between a second surface of the membrane and a first surface on a gas-diffusion cathode;
   (c) introducing oxygen-containing gas to a second surface on a said gas-diffusion cathode;
   (d) connecting said acid resistant anode and said gas-diffusion cathode with an external power supply for causing,
      (i) the oxygen to be reduced at said diffusion cathode to produce $O_2H^-$ ions, within said sodium hydroxide solution catholyte,
      (ii) the water in said sulfuric acid solution anolyte to be oxidized to produce hydrogen ions ($H^+$), within said sulfuric acid solution anolyte, and,
      (iii) the hydrogen ions ($H^+$) to move through the membrane from the sulfuric acid solution anolyte to the sodium hydroxide solution catholyte whereupon said hydrogen ions ($H^+$) react with the $HO_2^-$ ions to produce hydrogen peroxide within said sodium hydroxide solution catholyte; and, (e) withdrawing the sodium hydroxide solution catholyte and hydrogen peroxide from between the membrane second surface and the gas-diffusion cathode first surface as product.

5. The method of claim 4, wherein the sodium hydroxide solutio catholyte is circulated between the membrane second surface and the gas-diffusion cathode first surface until said sodium hydroxide solution catholyte has a sodium ion to hydrogen peroxide ratio of less than about 2.0 before withdrawing said sodium hydroxide solution catholyte and hydrogen peroxide as product.

6. The method of claim 4, wherein the sodium hydroxide solution catholyte is circulated between the membrane second surface and the gas-diffusion cathode first surface until said sodium hydroxide solution catholyte has a sodium ion to hydrogen peroxide ratio of less than 1.0 before withdrawing said sodium hydroxide solution catholyte and hydrogen peroxide as product.

7. The method of claim 4, wherein the sodium hydroxide solution catholyte is circulated between the membrane second surface and the gas-diffusion cathode first surface until said sodium hydroxide solution comprises approximately 5% by weight hydrogen peroxide before withdrawing said sodium hydroxide solution catholyte and hydrogen peroxide as product.

8. A method for producing a solution comprising sodium hydroxide and hydrogen peroxide comprising the steps of:

(a) passing a sulfuric acid solution anolyte between a lead oxide anode and a first surface on a membrane permeable to positive ions;

(b) passing a sodium hydroxide solution catholyte between a second surface on the membrane and a first surface on a gas-diffusion cathode;

(c) introducing oxygen-containing gas to a second surface on a said gas-diffusion cathode;

(d) connecting said acid resistant anode and said gas-diffusion cathode with an external power supply for causing, (i) oxygen to be reduced at said gas-diffusion cathode to produce $OH^-$ and $O_2H^-$ ions, within said sodium hydroxide solution catholyte, (ii) water in said sulfuric acid solution anolyte to be oxidized to produce hydrogen ions ($H^+$), within said sulfuric acid solution anolyte, and (iii) the hydrogen ions ($H^+$) to move through the membrane from the sulfuric acid solution anolyte to the sodium hydroxide solution catholyte whereupon said hydrogen ions ($H^+$) react with the $OH^-$ and $HO_2^-$ ions to produce water and hydrogen peroxide within sodium hydroxide solution catholyte, (e) circulating the sodium hydroxide solution catholyte between the membrane second surface and the gas-diffusion catholyte first surface until said sodium hydrogen solution comprises approximately 5% by weight hydrogen peroxide with a ratio of sodium ions to hydrogen peroxide having a value of less than 1.0; and (f) withdrawing a portion of said sodium hydroxide solution comprising approximately 5% by weight hydrogen peroxide as product from the circulating sodium hydroxide solution catholyte.

9. A method for producing a solution comprising sodium hydroxide and hydrogen peroxide comprising the steps of:

(a) passing a sulfuric acid solution anolyte between a ruthenium oxide anode and a first surface on a membrane permeable to positive ions; said membrane comprising Nafion 415, said sulfuric acid solution anolyte comprising a 1 molar solution of sulfuric acid;

(b) passing a sodium hydroxide solution catholyte between a second surface on the membrane and a first surface on a gas-diffusion cathode, said membrane separating the sulfuric acid solution and the sodium hydroxide solution, said sodium hydroxide solution comprising a 0.5 molar solution of NaOH, said gas-diffusion cathode comprising carbon black;

(c) introducing oxygen-containing gas to a second surface on a said gas-diffusion cathode, oxygen in said oxygen-containing gas diffusing through the gas-diffusion cathode from the second surface thereon to the first surface thereon;

(d) connecting said acid resistant anode and said gas-diffusion cathode with an external power supply for causing, (i) oxygen to be reduced at said diffusion cathode to produce $OH^-$ and $O_2H^-$ ions, within said sodium hydroxide solution catholyte, (ii) water in said basic aqueous electrolyte to be oxidized to produce hydrogen ions ($H^+$) within said sulfuric acid solution anolyte, and (iii) the hydrogen ions ($H^+$) to move through the membrane from the sulfuric acid solution anolyte to the sodium hydroxide solution catholyte whereupon said hydrogen ions ($H^+$) react with the $OH^-$ and $HO_2^-$ ions to produce water and hydrogen peroxide within sodium hydroxide solution catholyte;

(e) circulating the sodium hydroxide solution catholyte between the membrane second surface and the gas-diffusion catholyte first surface until said sodium hydroxide solution comprises approximately 5% by weight hydrogen peroxide with a ratio of sodium ions to hydrogen peroxide having a value of less than 1.0; and (f) withdrawing a portion of said sodium hydroxide solution comprising approximately 5% by weight hydrogen peroxide as product from the circulating sodium hydroxide solution catholyte.

* * * * *